United States Patent [19]

Knickerbocker

[11] Patent Number: 4,533,195

[45] Date of Patent: Aug. 6, 1985

[54] PRE-WIRED MODULAR CONNECTING BLOCKS

[75] Inventor: Robert H. Knickerbocker, Cheshire, Conn.

[73] Assignee: The Siemon Company, Watertown, Conn.

[21] Appl. No.: 122,017

[22] Filed: Feb. 15, 1980

Related U.S. Application Data

[60] Division of Ser. No. 937,043, Aug. 28, 1978, abandoned, which is a continuation-in-part of Ser. No. 815,270, Jul. 13, 1977, abandoned.

[51] Int. Cl.[3] ..... H01R 9/08

[52] U.S. Cl. ..... 339/97 P; 339/193 P

[58] Field of Search ..... 339/97 P, 98, 193 P

[56] References Cited

U.S. PATENT DOCUMENTS

| | | | |
|---|---|---|---|
| 3,523,268 | 8/1970 | Foster | 339/193 P |
| 3,851,114 | 11/1974 | Bush et al. | 179/98 |
| 3,936,119 | 2/1976 | Ayer | 339/17 F |

FOREIGN PATENT DOCUMENTS

| | | | |
|---|---|---|---|
| 1918591 | 9/1977 | Fed. Rep. of Germany | 339/98 |
| 2280215 | 2/1976 | France | 339/98 |

*Primary Examiner*—Joseph H. McGlynn

*Attorney, Agent, or Firm*—Fishman & Dionne

[57] ABSTRACT

A modular connecting block comprising a block of insulating material having a plurality of apertures therein, each aperture having inserted therein a plurality of flat elongated conductive elements, the elements including at least one pair of opposing contact fingers which protrude upwardly from and are integral with a base portion of the elements, the contact fingers extending through said apertures to allow for connection of wires to the elements, the elements including a tang which is integral with and extends from the base of the element. The modular connecting block may be prewired and includes a plurality of conductive circuits which connect the tangs to various contact points which are positioned external to the block. In another embodiment of the invention the block comprises a parallelepiped having a projecting edge along the bottom of one longitudinal side thereof. The projecting edge is interrupted at a predetermined distance from one end thereof by a recess and at the same distance from the other end by a securing protrusion. The width of the recess is at least as great as the width of the securing protrusion so that when such two blocks are placed with their projecting edges in face to face contact, the protrusion of one will mate with the recess of the other.

2 Claims, 14 Drawing Figures

PRE-WIRED MODULAR CONNECTING BLOCKS

This is a division of application Ser. No. 937,043, filed Aug. 28, 1978, now abandoned.

This application is a continuation in part of U.S. patent application Ser. No. 815,270 filed July 13, 1977, now abandoned.

BACKGROUND OF THE INVENTION (1) Field of the Invention

This invention relates to a modular quick connect terminal block that is small and easily mounted. More particularly, the invention relates to a quick connect terminal block which may be prewired and used as a junction box for telephones.

(2) Description of the Prior Art

Terminal connecting blocks are used extensively in the fields of electronics and communication. For example, they are used by the telephone industry in distribution cabinets for connecting conductors in a cable from an exchange to other conductors extending to various stations within a building. When a number of telephones are connected in a building, the person installing the telephones must connect an outside cable to conductors extending to various telephones within the building. The present method of installing telephones comprises manually securing the various wires in the outside cable to a distribution cabinet associated with the building. The wires from the telephones within the building are also manually connected to the distribution cabinet. In the distribution cabinet, the wires running to the telephones must be connected to the wires from the incoming cable. This type of connection requires a trained telephone installment person who knows which line from the cable to connect to the other lines directed to the telephones within the building. It should be understood that this process of connecting the telephones to the cable via a distribution cabinet is a time consuming task which is desirable accomplished by a skilled technician.

One type of terminal connecting block as disclosed in U.S. Pat. No. 3,234,498 comprises a plurality of connector elements arranged in spaced side-by-side rows of terminals in a connector block. Each element comprises a plurality of connectors joined together at a base portion. Each of the connectors is of the insulation penetrating type, i.e., the insulation on an electrical connecting wire is sheared when the wire is inserted in the conductor. U.S. Pat. No. 3,496,522 discloses interfitted conducting block modules containing insulation penetrating clips. The modules are constructed to facilitate piggy-back stacking.

My U.S. Pat. No. 3,836,942, issued Sept. 17, 1974 discloses and claims a separable electrical connector which permits a large number of additional electrical conductors to be connected to a terminal block containing clip-type electrical connectors without increasing the size of the block. The separable connector comprises a flat, elongate, electrically conductive element and a dielectric retaining member for holding the electrically conductive element in contact with the upper portions of laterally adjacent electrical connectors which project upwardly from a terminal block. The conductive element comprises a flat base portion and at least one, e.g., one or two, pair of opposing contact fingers which project upwardly from the base portion and are integral with the base portion. The adjacent edge portions of the contact fingers are adapted to receive an electrical conductor therebetween. The retaining member comprises a casing which encloses a portion of the electrically conductive element. The top portions of the opposing contact fingers project above the casing so that an electrical conductor may be inserted between the opposing fingers. This device is intended for use only in connection with an already installed connecting block.

It is an object of the present invention to provide a modular quick connect terminal block that may be prewired so that the wires of an incoming cable may be quickly mounted to the block in such a manner that the wires of the cable are associated properly with the various telephones in a building.

It is an object of this invention to provide a modular quick-connect terminal block that is small, easily mounted and can be fit into console wiring where a rack or panel mounted block is very often needed, and which does not require that it be mounted in connection with an already installed connecting block.

SUMMARY OF THE INVENTION

In accordance with the practice of the present invention there is provided a first embodiment of a modular circuit block which includes two parts. An upper block portion comprises insulating material and includes a plurality of apertures therein. Inserted within the apertures are a plurality of flat elongated conductive elements, the elements including at least one pair of opposing contact fingers which protrude upwardly from and are integral with a base portion of the element, the contact fingers extending through said apertures to allow for connection of wires to the elements. The elements also include a tang which is integral with and which extends from the base of the element. The block may be prewired by connecting wires which may be soldered or wire wrapped to the tangs. The wires may be wired to a plurality of contact points which are positioned external to the block so as to allow the contact points to be wired to incoming telephone cable. The second part of the modular circuit block is a base which can be secured to the upper portion of the block so as to protect the tangs and the pre-wired circuitry. The base also includes a plurality of holes which allow the block to be secured to a wall by screws which fit through the holes.

A telephone installation technician installing the afore-mentioned modular circuit block may carry a number of prewired blocks which are wired differently. The technician will choose a particular prewired block depending upon the desired electrical connection to be made between the flat elongated conductive elements and the wires of the cable. For a technician to install a telephone system, very little time is spent connecting the input wires from the cable to the wires leading to the telephones. Moreover, a home owner may easily connect additional telephones to the flat elongated conductive elements. Since the block is the interface between the telephone company's equipment and the customer owned equipment, the additional phones can be installed by the customer without tampering with telephone company equipment.

The base may be prewired in a conventional manner, that is, including wires soldered or wire wrapped to the tangs. However, in one embodiment of the invention, a printed circuit board is fit within a recess in the upper block portion. The printed circuit board can include a plurality of contact holes through which the tangs protrude when the upper block portion is secured to the base.

In accordance with a second embodiment of the invention, there is provided a modular block composed of a dielectric material containing a plurality of flat, elongated, electrically conductive elements. Each conductive element comprises a flat base portion and at least one pair of opposing contact fingers which project upwardly from the base portion and are integral with the base portion. The adjacent edge portions of the contact fingers are adapted to receive an electrical conductor therebetween. The block comprises a parallelepiped having a projecting edge along the bottom of one longitudinal side thereof. The projecting edge is interrupted at a predetermined distance from one end thereof by a recess therein and at the same distance from the other end by a protruding securing means The width of the recess is at least as great as the width of the securing means so that when two such blocks are placed with their projecting edges in face-to-face contact, the securing means of one will fit into the recess of the other.

The invention will be more particularly described with reference to the accompanying drawings wherein FIG. 1 is a top plan view of a modular block containing a plurality of electrical conductive elements.

DETAILED DESCRIPTION OF THE INVENTION

Figure 1:
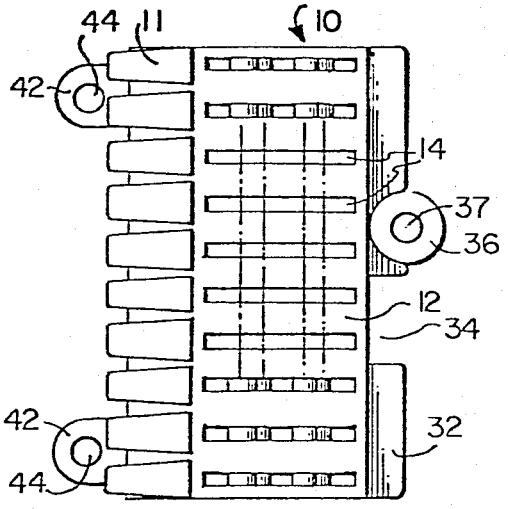

Turning more particularly to FIGS. 1–5, there is shown a modular block 10 which may be formed of a suitable dielectric or electrical insulating material such as a phenol-formaldehyde resin or a polyvinyl resin. The block contains a conventional fanning strip 11 which projects upwardly along one longitudinal side of the top 12 of the block 10. The block 10 contains a number of parallel slots 14 which extend through the main portion of block 10 to but not through the bottom 16. Registering with each slot 14 are three spaced apart openings 18 which extend through the bottom 16.

Figure 8:
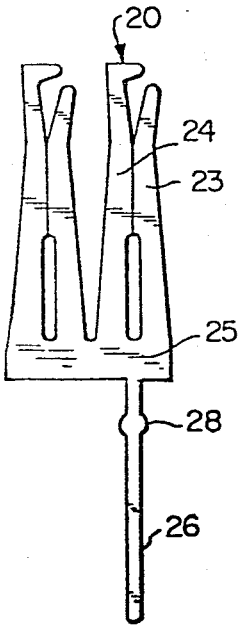
FIG. 8 is a side elevational view of one of the flat, elongate electrically conductive elements.

Each of the slots 14 contains one or two flat, elongate electrically conductive elements, shown in detail in FIG. 8. The elements may be constructed of any suitable resilient conducting material such as phosphor-bronze, beryllium copper or other known metal alloy. Each electrically conductive element 20 includes at least one pair of opposing contact fingers 23 and 24 which are joined at one end to a base portion 25. Each pair of opposing contact fingers 23 and 24 form a pair of mutually opposed edges which shear the insulation from an electrical conductor inserted therebetween. Between these mutually opposed edges and above the base portion 25 are slots.

Extending perpendicular to the base portion 25 is a tang 26. In the embodiment shown, there is a protuberance 28 on the tang 26 situated just below the bottom of the base portion 25. The protuberance 28 serves to hold the electrically conductive element tightly in place in the block 10. Thus, when the electrically conductive element is inserted into the block, the tang 26 is pushed through one of the openings 18 in the bottom 16. The openings 18 are slightly smaller than the diameter of the protuberance 28 and the plastic surrounding the opening 18 is resiliently deformed as the protuberance 28 passes therethrough. After the protuberance 28 has passed through the opening, the sides of the opening 18 engage the protuberance and hold the conductive element tightly in place. It will be appreciated that this means for securing an electrically conductive element in place may be used in other types of blocks wherein a tang extends through the base of the block such as shown in my co-pending applications Ser. No. 262,495, filed June 14, 1972 and Ser. No. 507,972, filed Sept. 20, 1974.

Rather than have the conductive elements secured in place by means of the protuberance 28, they may also be held in place by having the openings 18 tightly engage that portion of the tang adjacent the base portion 25.

The tangs 26 provide tails which may be wire wrapped to allow for electrical connection between the tangs. If a wire wrap tail is not required, tangs 26 may be clipped off at the base or at protuberance 28. Alternatively, the electrically conductive element 20 may be supplied without tangs 26 in which case the elements 20 may be held in place by frictional engagement with the sides of the slots 14 at the base area at 25.

Figure 3:
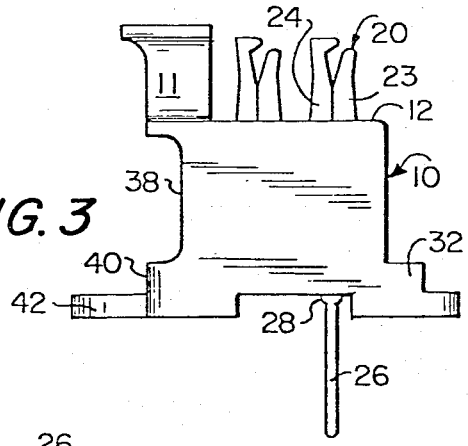
FIG. 3 is an end elevational view of the block.
Figure 7:
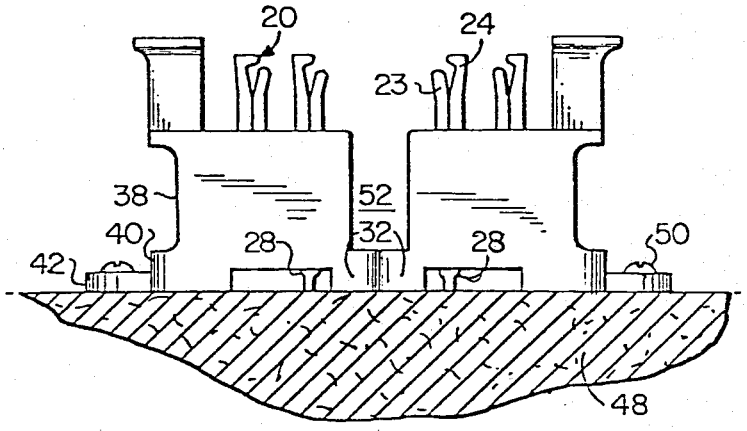
FIG. 7 is an end or side elevational view corresponding to FIG. 6.

In the embodiment shown, the conductive element comprises two pairs of fingers joined together at a common base portion 25. However, the pairs of fingers may be independent of one another at base area 25 in which case each pair of fingers would have a tang extending from the base portion 25 so that there would then be two rows of tangs independent of each other instead of one as shown in FIGS. 3 and 7.

Figure 2:
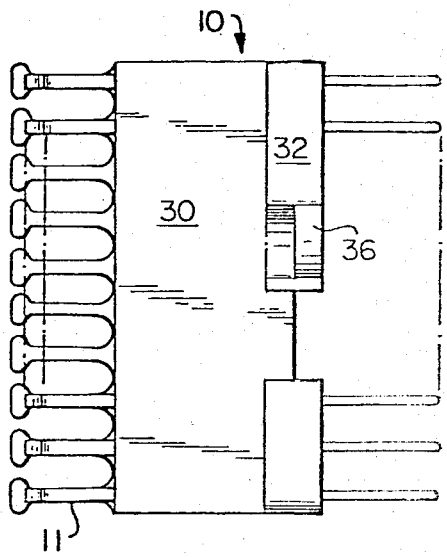
FIG. 2 is a front elevational view of the block.
Figure 6:
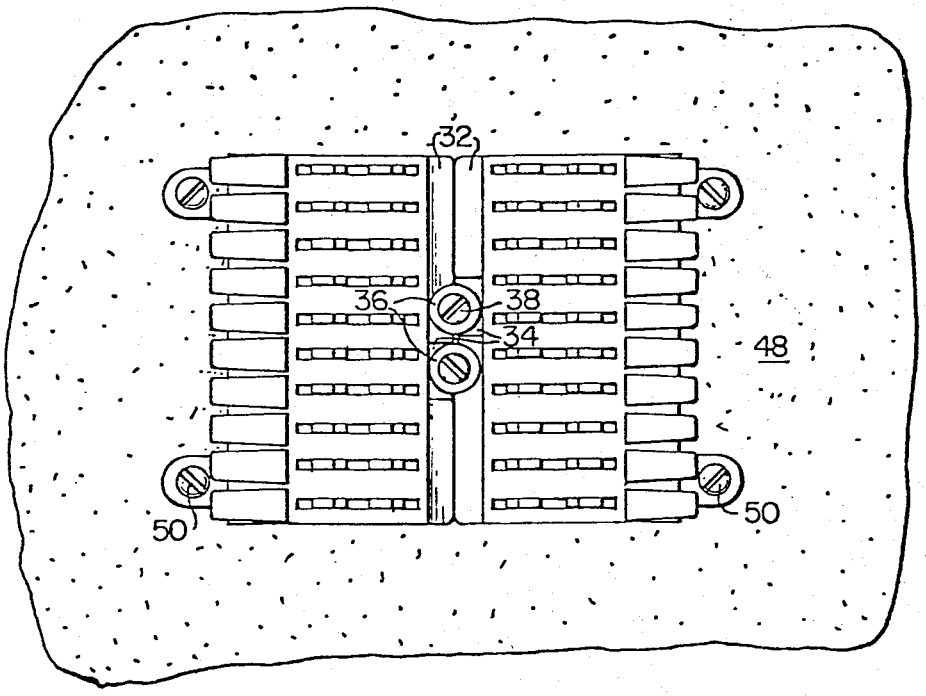
FIG. 6 is a top plan view of two interconnected blocks secured to a section of a panel.

Each block 10 contains a longitudinally extending front portion 30. Extending the length of the front 30 and located at the bottom thereof is a projecting edge 32. At a predetermined distance from one end of the edge 32 it is interrupted by a recess 34 and at the same distance from the other end the edge contains a protruding securing means 36 containing a hole 37. The width of the recess 34 is at least as great as the width of the securing means 36 so that when two blocks 10 are placed with the projecting edges 32—32 in face-to-face contact, the securing means 36 of one will fit into the recess 34 of the other as shown in FIGS. 6 and 7. As best shown in FIG. 2, the top of the securing means 36 is spaced below the top of the edge 32 so that when a screw is placed through the hole 37, the head of the screw will not extend above the top of the edge 32.

The back 38 of the block 30 has a projecting edge 40. Near each end of the edge 40 are protruding securing means 42 containing holes 44. The block may be secured to a panel 48, shown in FIGS. 6 and 7, by means of screws 50. When two blocks are placed with their projecting edges 32—32 in face-to-face contact, with the securing means 36 of one fitting into the recess 34 of the other, there is hereby provided a compact interlocking of the two blocks. Above the facing edges 32—32, there is a channel 52 which provides support for and storage space for a conductor cable and/or electrically conductive wires.

The bottom 16 of the block 10 also contains two rear mounting holes 46 for rack mounting. Thus, these holes may be used to mount the modular blocks of this invention on a panel such as disclosed in U.S. Pat. No. 3,846,590, the disclosure of which is incorporated herein by reference, or on any other type of panel wherein there is easy access to the back side of the panel. These holes are also provided to accept a printed circuit board that can be screwed on base of block, making contact with preinstalled conductive elements at the tang 26 thus creating a precircuited unit.

This invention fulfills the growing need for quick-connect blocks that are small, easily mounted and can be fit into console wiring where a rack or panel mounted block is very often needed. The combination of two of these blocks in interlocking relationship permits the addition of a maximum number of connectors in a minimum amount of space.

Figure 9:
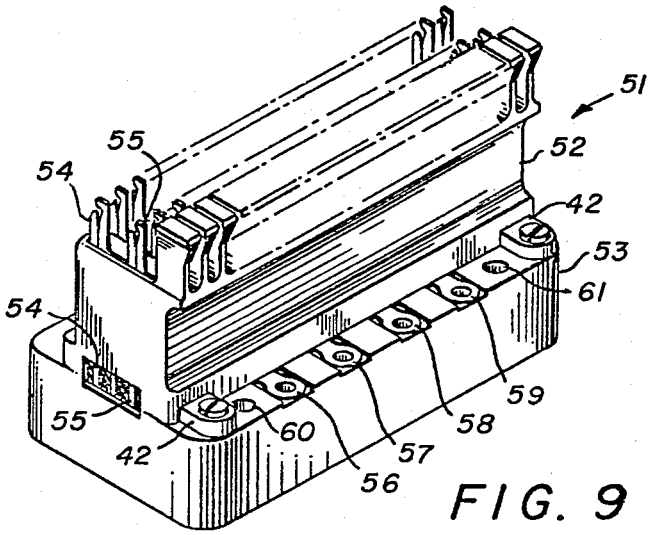
FIG. 9 shows an upper front perspective view of a prewired modular connecting block.

FIG. 9 shows a prewired modular connecting block 51 including an upper block portion 52 and a base 53. Upper block portion 52 is a block of a type similar to that described with respect to FIGS. 1–8. The circuit block shown in FIG. 9 differs from the previously described circuit blocks in that the conductive element 20 shown in FIG. 8 is no longer used. Rather, circuit block 51 includes at least two rows of independent elements 54 and 55. If element 20 shown in FIG. 8 were cut at its base to sever the left hand portion of the element, an independent element such as elements 54 and 55 would be provided. Base 53 includes a plurality of connectors 56, 57, 58 and 59 which allow for connection of wires from a cable. The base also includes attachment holes 60 and 61 which allow the base 53 to be attached to a supporting surface such as the wall of a building. The opposite side of the base includes securement holes 62 and 63 which serve the same purpose as holes 60 and 61.

Figure 4:
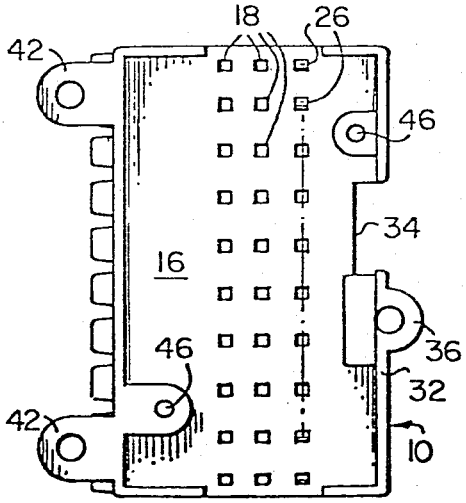
FIG. 4 is a bottom plan view of the block.
Figure 5:
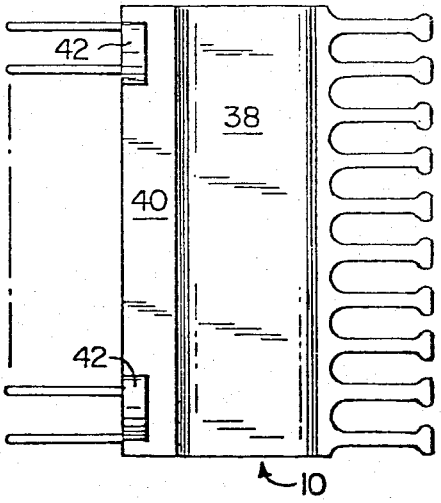
FIG. 5 is a rear elevational view of the block.
Figure 10:
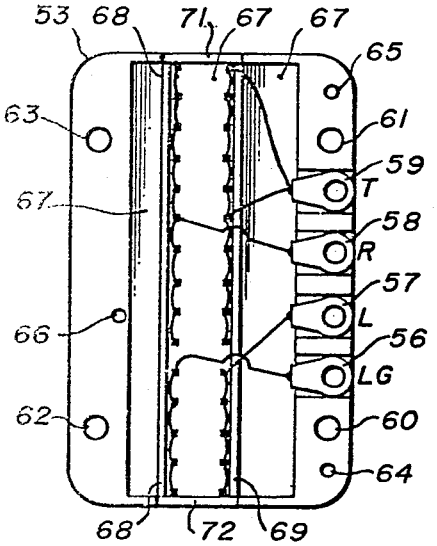
FIG. 10 shows a top plan view of the base shown in FIG. 9.
Figure 11:
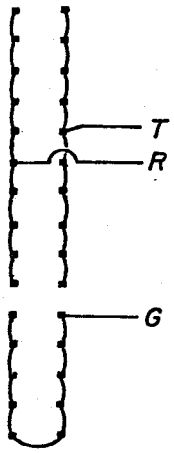
FIG. 11 shows a schematic of an alternative circuit connection for the base shown in FIG. 10.
Figure 12:
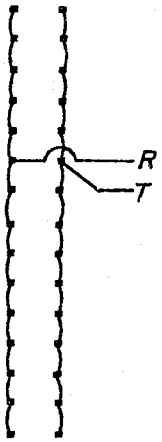
FIG. 12 shows a schematic of another alternative circuit connection for the base shown in FIG. 10.

As best shown in FIG. 10, base 53 includes three attachment holes 64, 65 and 66 which align with protruding securing means 42 and a securing protrusion 36 which is not shown in FIG. 9 but which is shown in FIG. 4. Base 53 includes a rectangular recess 67. Protruding upwardly from recess 67 are two parallel walls 68 and 69 which prevent the movement of the tangs of elements 54 and 55 outwardly with respect to one another when the upper portion 52 is secured to base 53. If the tangs from elements 54 and 55 are allowed to move outwardly with respect to one another, the contact fingers of the respective elements may touch thus making an undesirable electrical contact or short circuit. As shown in FIG. 10, the tangs of elements 54 and 55 allow for connection of wires by a conventional wire wrap technique. Connectors 56, 57, 58 and 59 are preferably made of metal and have extending therefrom wires which are wire wrapped to various tangs. It should also be understood that the tangs can be wired with respect to one another in any desired manner. Thus, as can be seen in FIGS. 10, 11 and 12, block 53 can be wired in any manner desired. The abbreviations T, R, L, LG and G as shown in FIGS. 10, 11 and 12, are conventional abbreviations for tip, ring, light, light-ground and ground. It should be understood that the circuit patterns shown are exemplary of the many possible prewired circuit patterns. A technician installing a modular connecting block can choose from any number of different prewired blocks to avoid wiring the block in the field. Base 53 also includes access gaps 71 and 72 which match with access gaps on the bottom of upper portion 51. Gaps 71 and 72 provide a space for wire wrapped tails.

Figure 13:
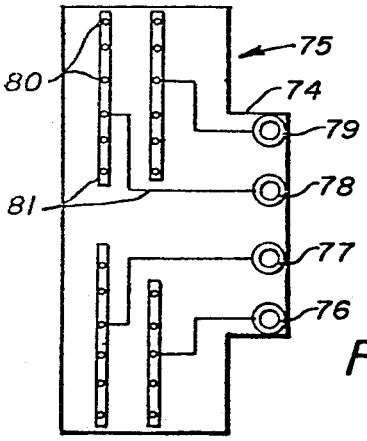
FIG. 13 shows a top plan view of a printed circuit board which can be fitted to the circuit block shown in FIG. 4.
Figure 14:
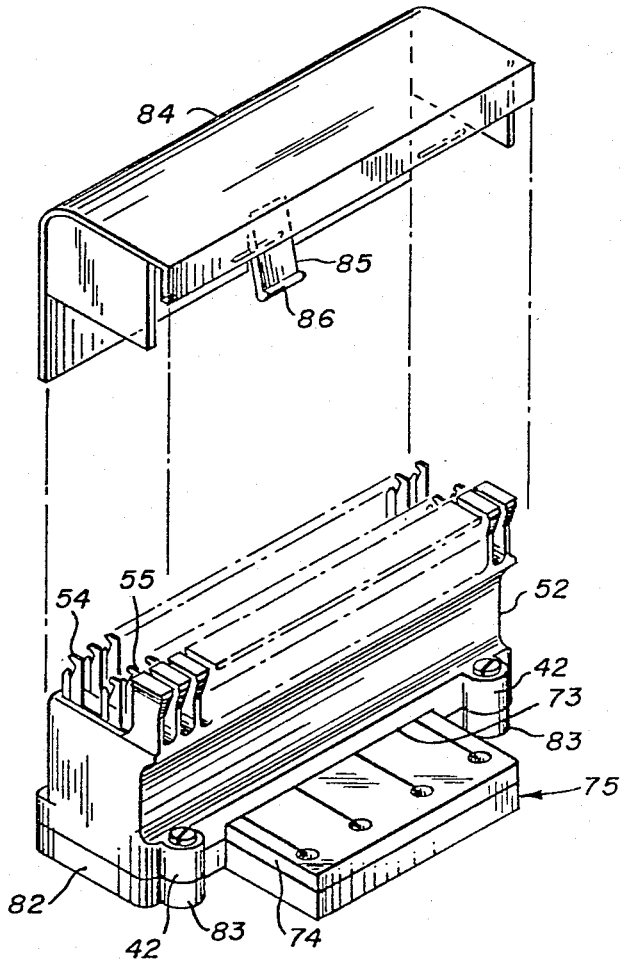
FIG. 14 shows an upper front perspective view of modular circuit block of the type including a printed circuit board.

FIG. 14 shows a prewired modular connecting block wherein rather than using individual wires to connect the tangs, a printed circuit board is used. The upper portion 52 of the circuit block is modified to provide a gap 73 which allows for tongue 74 of printed circuit board 75 to protrude therethrough. Printed circuit board 75 fits within the upper portion 52. More particularly, printed circuit board 75 fits within a recess defined by an outer edge similar to edge 32 as described with respect to FIG. 4. As shown in FIGS. 13 and 14, printed circuit board 75 includes a plurality of contacts 76, 77, 78 and 79 which may be connected to a cable. Circuit board 75 also includes a plurality of apertures 80 which allow for the interfitting of tangs of elements 54 and 55. Connectors 76, 77, 78 and 79 may be connected to the printed circuitry 81 in the patterns shown in FIGS. 11, 12 or 13 or in any other desired pattern. With the use of printed circuit board 75, securement means 46 as shown in FIG. 4 may be omitted so that a circuit board 75, having a generally rectangular shape, may be fitted within the recess defined by edge 32 as shown in FIG. 4.

FIG. 14 shows a manner in which printed circuit board 75 is secured to upper portion 52 Retainer plate 82 has a generally planar surface which abuts the edge of upper portion 52. Retainer plate 82 is provided with securement means 83 which align with securement means 42. When retainer plate 82 is affixed to upper portion 52, printed circuit board 75 is firmly maintained in place and connected to elements 54 and 55. With the prewired circuit block shown in FIG. 14, apertures 72 and 71 may be omitted.

Also, as shown in FIG. 14, the circuit blocks of the present invention may optionally include cover 84 which is shaped to fit over elements 55 and 56 so as to protect these elements from moisture and debris. Protruding downwardly from cover 84 is a retaining arm 85 which includes retaining lip 86. Retaining arm 85 fits through a gap similar to the gap 34 shown in FIG. 4 and retaining lip 86 releasably engages the edge provided by the gap.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A pre-wired modular connecting block comprising: a housing, said housing being formed from a dielectric material and including:

a body portion, said body portion having a shape of a parallelepiped, said body portion having a plurality of slots formed in a first planar surface portion thereof, said slots extending part way through said body portion, said body portion further having a plurality of apertures extending inwardly from a second face thereof disposed oppositely to said first face portion, said apertures communicating with said slots and being arranged in rows and columns;

a rim portion integral with and extending from said body portion second face, said rim portion defining an edge extending at least part way around at least a portion of said body portion second face, said rim portion and body portion second face cooperating to define a recessed area; and a plurality of apertured securing protusions extending outwardly from said rim portion, said apertures in said protusions having axes which are generally parallel with said body portion apertures;

a plurality of insulation piercing electrically conductive contact members, said contact members being disposed in at least some of said slots in said housing body portion, said contact members each including:

a flat support portion having a pair of oppositely disposed edges;

at least one pair of oppositely disposed contact fingers projecting upwardly from and being integral with a first edge of said support portion; and a tang of rectangular cross-section extending from the said second edge of said support portion, said tang being co-planar with said support portion and extending through one of said apertures into the said recessed area, said tang being engaged by said housing body portion to thereby retain the contact element in said housing with said fingers extending above the said first face portion of said housing body portion; and wherein said contact member tangs extend outwardly beyond a plate defined by said housing rim portion;

base means, said base means being formed from a dielectric material, said base means having a pair of oppositely disposed flat mounting surfaces which lie in parallel planes, said base means being provided with apertures extending therethrough between said mounting surfaces, said apertures being spaced apart by the same distance as said apertures in said housing securing protusions whereby said base means may be mounted on a support surface with a first mounting surface in abutting contact therewith and said housing may be mounted on said base means with said rim portion in contact with said second mounting surface, said base means when said housing is mounted thereon cooperating with said rim portion and body portion second face to define a cavity between said housing and said base means;

and wherein said base means is provided with a recess bounded by said second mounting surface, said recess forming part of said cavity and said tangs extending into said recess, and wherein said base means recess is sub-divided by a plurality of parallel walls, said walls serving to prevent lateral movement of said tangs, means removably securing said housing to said base means; and circuit means disposed in part in said cavity and connected to said contact member tangs for electrically interconnecting said contact members in preselected groups, said circuit means including a plurality of conductors equal in number to said groups of contact members, said conductors extending outwardly from said cavity in a direction generally transverse to the axes of said securing protusion apertures so as to be available to the exterior of said connecting block.

2. The connecting block of claim 1 further comprising: a detachable cover.

* * * * *